US005931705A

United States Patent [19]

Young

[11] Patent Number: 5,931,705

[45] Date of Patent: Aug. 3, 1999

[54] SURFACE MOUNT WIRE CONNECTOR

[75] Inventor: Richard A. Young, St. Petersburg, Fla.

[73] Assignee: Thomas & Betts International, Sparks, Nev.

[21] Appl. No.: 08/919,916

[22] Filed: Aug. 28, 1997

Related U.S. Application Data

[60] Provisional application No. 60/025,914, Sep. 11, 1996.

[51] Int. Cl.[6] ..... H01R 13/10

[52] U.S. Cl. ..... 439/682; 439/940

[58] Field of Search ..... 439/83, 381, 525, 439/857, 869, 862, 682

[56] References Cited

U.S. PATENT DOCUMENTS

| | | | |
|---|---|---|---|
| 2,855,579 | 10/1958 | Wintress | 439/381 |
| 3,778,754 | 12/1973 | Takahashi et al. | 439/525 |
| 4,060,296 | 11/1977 | Kunkle et al. | 439/869 |
| 4,682,829 | 7/1987 | Kunkel et al. . | |
| 4,837,927 | 6/1989 | Savage, Jr. | 439/857 |
| 4,955,820 | 9/1990 | Yamada et al. . | |
| 5,104,324 | 4/1992 | Grabbe et al. . | |
| 5,277,597 | 1/1994 | Masami et al. . | |
| 5,451,174 | 9/1995 | Bogursky et al. . | |
| 5,476,389 | 12/1995 | Ono . | |
| 5,535,513 | 7/1996 | Frantz . | |

*Primary Examiner*—Steven L. Stephan
*Assistant Examiner*—Javaid Nasri
*Attorney, Agent, or Firm*—Hoffmann & Baron, LLP

[57] ABSTRACT

An improved surface-mount electrical wire connector includes a connector housing and electrical contacts. The housing supports the electrical contacts and includes an upper surface with openings to receive the stripped ends of electrical wire. The upper surface includes an enhanced bearing surface established between a pair of openings by selectively chamfering the perimeter of the openings. This enhanced surface accommodates a suction-cup head on conventional pick-and-place assembly equipment. The electrical contacts include an upper section for receiving and retaining a wire and a lower section, extending through a lower surface of the housing, for solderably affixing the connector to a printed circuit board. The lower section of the contacts preferably include two, parallel, spaced apart members which provide four exposed surfaces to receive and retain solder.

5 Claims, 3 Drawing Sheets

SURFACE MOUNT WIRE CONNECTOR

This application claims the benefit of U.S. Provisional Application No. 60/025,914, filed on Sep. 11, 1996.

FIELD OF THE INVENTION

The present invention is directed to an electrical connector for terminating stripped ends of electrical wires. The connector of the present invention is designed to be positioned on a printed circuit board.

BACKGROUND OF THE INVENTION

Previously, electrical connectors designed for connection to a printed circuit board employed electrical contacts having tail portions which extend through the housing of the connector. The tail portions of such contacts are designed to be inserted into plated through-holes in the printed circuit board. However, use of printed circuit boards having plated through-holes to accommodate the tails of the contacts are expensive to manufacture as the entire through-hole must be plated with a conductive material. Additionally, modem reflow solder techniques are not effective for soldering through-hole components, thus requiring an additional manufacturing step for standard connectors such as hand soldering or wave soldering.

Connectors which are adapted for surface-mounting on a printed circuit board are generally known in the art. For example, U.S. Pat. No. 4,682,829 to Kunkle et al. discloses a surface mount socket including a plurality of terminals arranged for receiving dual in-line packaged components.

Other United States patents which disclose various structures for surface-mount connectors include: U.S. Pat. No. 4,955,820 to Yamada et al. which is directed to a T-leg SMT contact; U.S. Pat. No. 5,277,597 to Masami et al. which is directed to a thin, applied-to-surface type electric connector; U.S. Pat. No. 5,451,174 to Bogursky et al. directed to surface mounted pins for printed circuit boards; and U.S. Pat. No. 5,535,513 to Frantz which is directed to a method for making surface mount connectors.

The connectors described above are generally directed to accommodating another connector structure and do not permit the easy accommodation of individual wires for electrical connection to the printed circuit board.

OBJECTS AND SUMMARY OF THE INVENTION

It is an object of the present invention to provide an improved surface-mount electrical connector.

It is another object of the present invention to provide an improved electrical connector for providing interconnection between a printed circuit board and stripped wires.

It is yet another object of the present invention to provide an electrical connector with contacts which facilitate an improved electromechanical solder joint to a printed circuit board.

It is a further object of the present invention to provide an improved electrical connector for receiving and retaining stripped wires.

It is yet another object of the present invention to provide a connector which has reduced center-to-center wire insertion openings while still allowing placement on a printed circuit board by standard, vacuum, pick-and-place equipment.

In accordance with one form of the present invention, a surface mountable electrical connector includes a generally rectangular housing which receives and retains at least two electrical contacts. The housing is formed from an electrically insulative material and includes an upper end with openings corresponding to the electrical contacts to receive the stripped ends of electrical wires therein. The openings in the upper end are preferably formed with a substantially rectangular outline with three chamfered surfaces which provide a funnel-like entry for a wire. The fourth side, which opposes an adjacent opening, is preferably non-chamfered thereby providing sufficient surface area between contact openings to accommodate a suction cup like vacuum head of a conventional pick-and-place machine.

The electrical contacts extend from a bottom opening of the housing and include solder tails which are formed to reside parallel to a printed circuit board onto which the connector is to be mounted. Preferably, each solder tail includes two spaced apart and substantially parallel beam members to provide an enhanced solder connection. The contacts further include upper extents formed to receive and retain a wire.

These and other objects, features and advantages of the present invention will become apparent from the following detailed description of illustrative embodiments thereof, which is to be read in connection with the accompanying drawings.

DETAILED DESCRIPTION OF THE PREFERRED EMBODIMENTS

Referring generally to FIGS. 1–6, an electrical connector 10 formed in accordance with the present invention is shown. Connector 10 includes a generally rectangular housing 11 which supports at least one electrical contact 12 therein. Connector 10 is designed to be positioned and affixed on a printed circuit board P and receive the stripped ends of insulated wires W.

Figure 6:
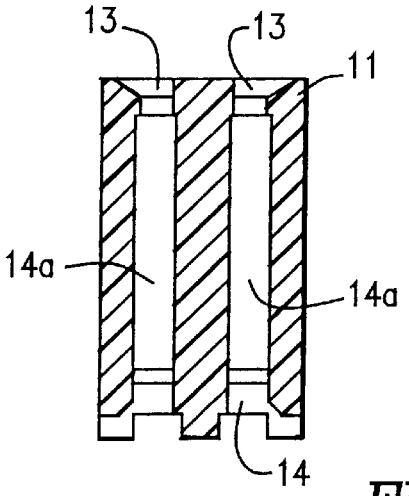
FIG. 6 is a cross-sectional view of a connector housing formed in accordance with the present invention.

Housing 11, shown in further detail in FIG. 6, is formed of electrically insulative thermoplastic material, such as PPS, which preferably is capable of withstanding reflow solder temperatures of up to 250° C. and meets Underwriters Laboratories 94V-0 requirements. Housing 11 includes an upper end having openings 13 through which the stripped ends S of the electrical wires W may be inserted. Housing 11 further includes bottom openings 14 through which electrical contacts 12 may be inserted for residence within slots 14*a* of housing 11.

Figure 7:
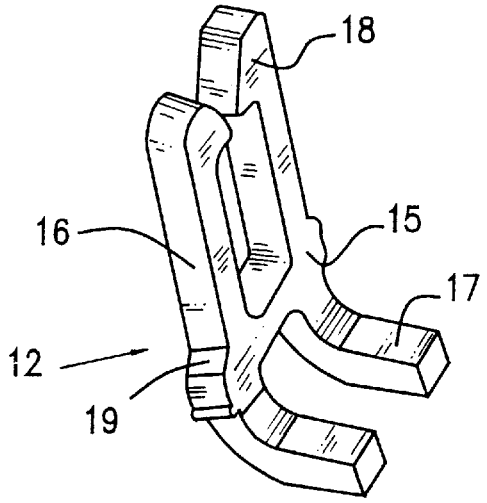
FIG. 7 is a perspective view of a contact formed in accordance with the present invention.
Figure 8:
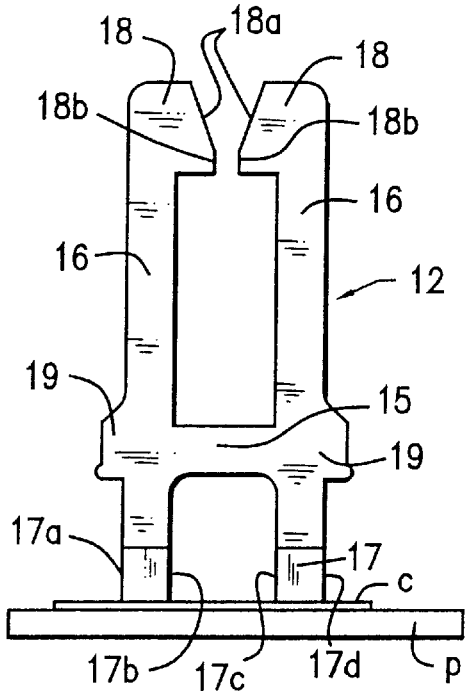
FIG. 8 is a front elevation view of a contact formed in accordance with the present invention shown in cooperation with a printed circuit board.
Figure 9:
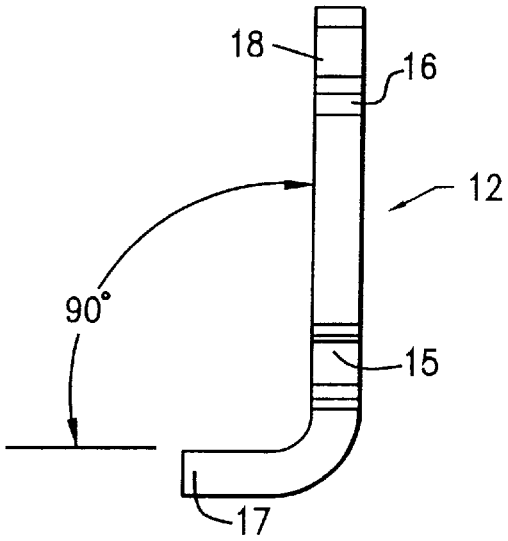
FIG. 9 is a side elevation view of a contact formed in accordance with the present invention.

FIGS. 7–9 illustrate a preferred embodiment of electrical contacts 12. Contacts 12 are formed of a suitable conductive metal such as tin plated phosphor bronze. Each contact 12 includes a transverse contact body 15 with a pair of spaced apart contact beams 16 extending upwardly therefrom. A pair of lower extending spaced apart contact solder tails 17 extend downwardly from transverse body 15. Solder tails 17 have a generally arcuate central portion so that the outer extent of tail 17 extends at approximately a 90° angle from beams 16. The two solder tails 17 are preferably spaced apart and substantially parallel to each other. This arrangement provides four exposed surfaces 17*a, b, c* and d to receive and retain solder. This results in a more reliable electrical connection as well as a stronger mechanical connection to a printed circuit board P.

The upper extents of beams 16 include inwardly directed conductor engaging portions 18. Each conductor engaging portion 18 preferably includes a tapered lead-in surface 18*a* which forms a funnel-like entry for insertion of the stripped end of the electrical wire. At the bottom end of the tapered lead-in surfaces 18*a*, walls 18*b* are relatively parallel so as to grip the stripped end of the wire inserted therethrough. Such a construction prevents the stripped end of the wire, once inserted between the beams 16, from being easily removed therefrom. The straight walls 18*b* dig into or engage the stripped wire end, providing secure retention.

Figure 2:
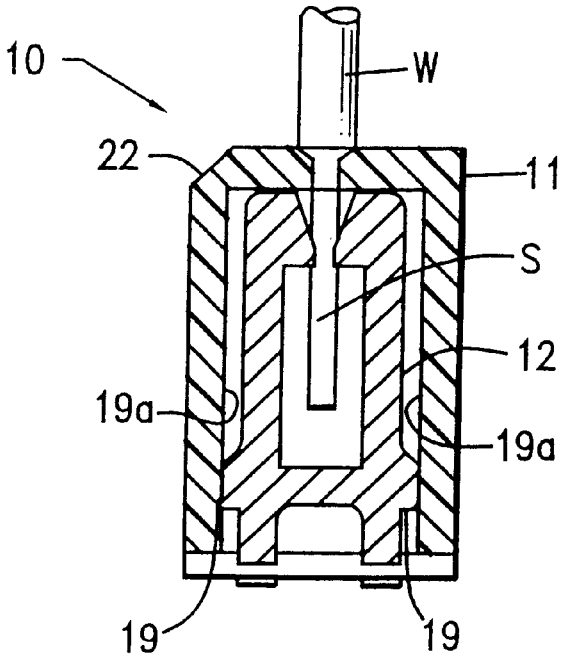
FIG. 2 is a cross-sectional view, taken along line 2—2 from FIG. 4, of a surface mount wire connector formed in accordance with the present invention.
Figure 3:
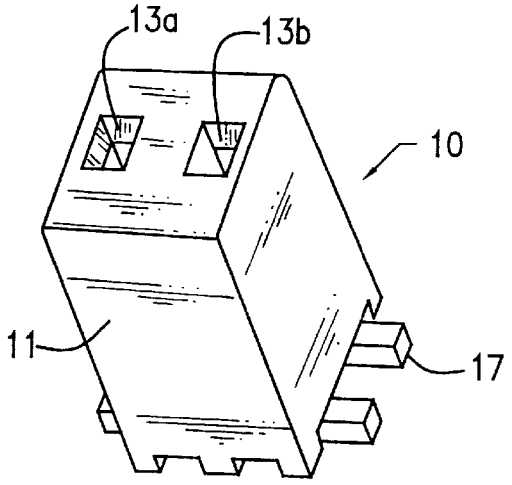
FIG. 3 is a perspective view of a two position surface mount connector formed in accordance with the present invention.
Figure 4:
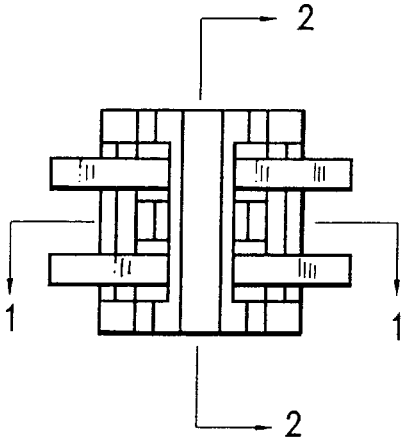
FIG. 4 is a bottom plan view of a surface mount connector formed in accordance with the present invention.

One contact 12 is inserted into each opening 14 of housing 11. The conductor engaging portions 18 are resident adjacent openings 13 and the solder tails 17 extend outwardly of opening 14. Transverse contact body 15 of contact 12 includes a retention barb 19 at each end thereof. Retention barb 19 includes a sharp edge which digs into appropriate grooves 19*a* on the inner walls of housing 11 to retentively retain contacts 12 within housing 11, as illustrated in FIG. 2.

Figure 1:
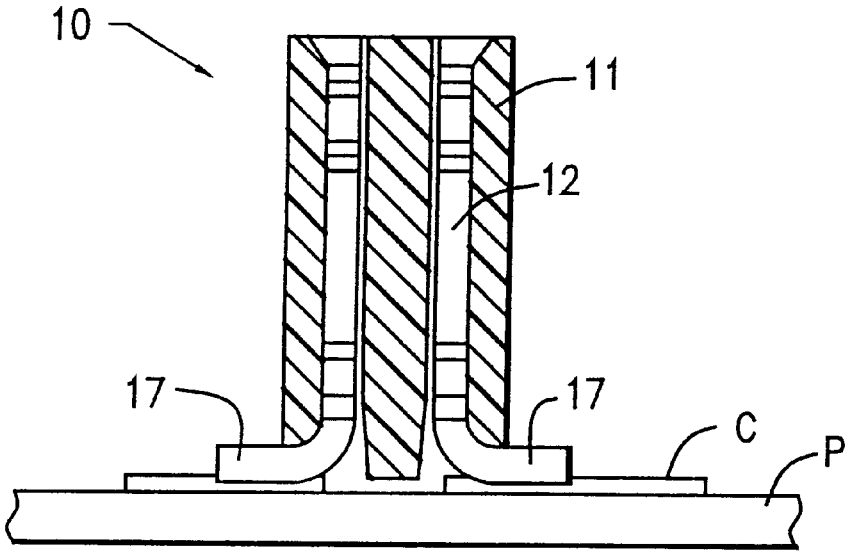
FIG. 1 is a cross-sectional view, taken along line 1—1 from FIG. 4, of a surface mount wire connector formed in accordance with the present invention.

Referring additionally to FIG. 1, after the contacts 12 are securely retained within housing 11 the connector 10 may be positioned over a printed circuit board P. The solder tails 17 extend outwardly from housing 11 at the lower end and may be positioned over conductive solder pads C of the printed circuit board P. The solder tails 17 may be soldered to the solder pads of the printed circuit board in a conventional fashion so as to mechanically and electrically connect connector 10 to the printed circuit board. As the solder tails 17 extend at a 90° angle from beams 16 of contact 12, the solder tails 17 are visible when the connector 10 is positioned over the printed circuit board. Thus, upon soldering the solder tails 17 to the solder pads of the printed circuit board, a visual inspection of the proper soldering of the tails to the solder pad is permitted. This provides assurances that proper electrical connection is established between connector 10 and the printed circuit board.

Once the connector 10 is properly positioned on the printed circuit board P, wires W may be inserted into the openings 13. The wires are preferably stripped so as to have a strip length of about 0.250 inches ±0.030 inches. This stripped length allows a sufficient extent to be inserted between the beams 16 of contacts 12. Openings 13 are selected to be smaller than the diameter of the wire insulation. This prevents over-insertion of the wire into connector 10. In a preferred embodiment of the connector 10, wire sizes of 24–26 AWG can be inserted and retained.

Connector 10 includes a further feature in that it provides an indication of orientation or polarity to assure identification of a particular wire. As illustrated in FIG. 2, connector housing 11 includes a chamfered or beveled edge 22 at the upper end thereof. Edge 22 extends along one side of housing 11 and provides an orientation reference so that the position and orientation of the housing can be identified. Openings 13 can be identified as a "right" or "left" opening with reference to edge 22. It is further contemplated that edge 22 can extend only over one opening 13 rather than fully across housing 1I1 so as to provide a further indication of orientation and polarity.

The present invention provides a further advantage in that the connector 10 may be used with automatic pick-and-place machine. Machines such as these are well known in the art and allow the connector 10 to be positioned on a printed circuit board in automatic fashion. Such pick-and-place machines typically use a vacuum suction cup-like device (not shown) which would engage the top of the connector to transport the connector to the printed circuit board and precisely locate the connector over the solder pads of the printed circuit board. Typically, such pick-and-place machines employ a suction cup-like device having a diameter of about 0.060 inches. Thus the connector, in order to be used with such pick-and-place machines, must have an upper surface which will accommodate the suction cup-like device. Previously this required the connectors to be of larger size in order to have a sufficient bearing surface to accommodate the suction cup-like device.

Figure 5:
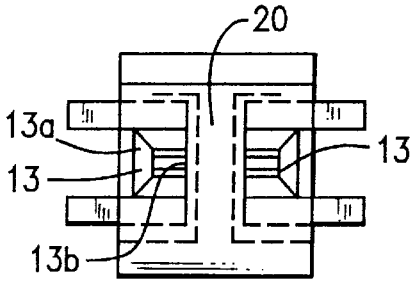
FIG. 5 is a top plan view of a surface mount connector formed in accordance with the present invention.

The present invention allows use with an automated pick-and-place machine without increasing the size of the connector. As shown in FIG. 5, upper openings 13 are spaced apart a sufficient distance, approximately 0.068 inches, and are selectively chamfered about their perimeter to provide a central location 20 for accommodation of the suction cup-like device of the pick-and-place machine. Preferably, such surface 20 is established by forming each opening 13 with a rectangular perimeter having three chamfered sides 13*a* which establishes a funnel-entry for the wire into the connector 10. However, the fourth side 13*b*, which opposes the opposite opening 13, is non-chamfered. The selective positioning of chamfered and non-chamfered sides defines a housing bearing extent 20 which provides for wire lead in as well as produces a surface to accommodate the suction cup-like device of the pick-and-place machine.

Figure 10:
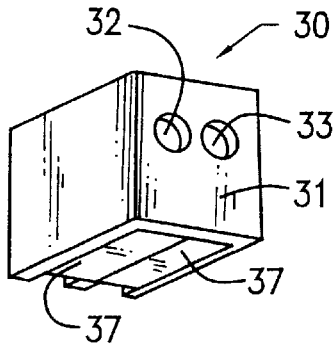
FIG. 10 is a perspective view of an alternate embodiment of the present invention which accommodates the insertion of wires in a direction parallel to a printed circuit board.

While the present invention has been described with respect to a housing which allows insertion of wires from above in a vertical direction, a side entry housing may also be employed. Such side entry connector 30 is shown in FIG. 10. Connector 30 includes a housing 31 supporting electrical contacts 32. Contacts 32 are substantially similar to contacts 22 of the above embodiment. Contacts 32 include tails 37 which extend directly below housing 31 for engagement with solder pads of a printed circuit board. The contacts 32 are accessible through openings 33 in a side insertion fashion, that is, in a direction parallel to the printed circuit board.

Although illustrative embodiments of the present invention have been described herein with references to the accompanying drawings, it is to be understood that the invention is not limited to those precise embodiments, and that various other changes and modifications may be effected therein by one skilled in the art without departing from the scope of the present invention.

What is claimed:

1. A surface-mount electrical connector for mounting on a printed circuit board and terminating stripped ends of electrical wires, said connector comprising:

at least two electrical contacts, each of said electrical contacts comprising an upper section with wire retaining means and a lower section with solder tails for solderably affixing the connector to a printed circuit board; and a connector housing, said housing having a first surface with at least two openings to receive said stripped ends of said electrical wires and a second surface opposing said first surface, said at least two openings accommodating said electrical contacts therein, said openings being spaced apart and said housing selectively including chamfered and non-chamfered side surfaces about said openings, wherein each of said openings includes a substantially rectangular perimeter with three said chamfered side surfaces and a fourth said non-chamfered side surface with said non-chamfered side surfaces of said openings being in non-facing opposition so as to provide an extended bearing surface between said openings to accommodate automated handing by vacuum pick-up means.

2. An electrical connector as defined by claim 1, wherein said solder tails include two tail extents, said tail extents being spaced apart and aligned substantially parallel to one another.

3. An electrical connector as defined by claim 1, wherein said housing first surface includes a substantially rectangular perimeter having four edges, one edge of said perimeter being beveled to provide a polarity indicating reference.

4. An electrical connector as defined by claim 1, wherein said solder tails extend beyond said connector housing second surface such that said solder tails are visibly exposed when the connector is mounted on said printed circuit board.

5. An electrical connector as defined by claim 2, wherein said wire retaining means of said contacts comprises two substantially parallel beam members having an upper open portion, said upper portion including inwardly directed conductor engaging members.

* * * * *